US005685440A

United States Patent [19]

Mason

[11] Patent Number: 5,685,440

[45] Date of Patent: Nov. 11, 1997

[54] DRYING RACK

[76] Inventor: Michael L. Mason, 2176 Bumpy Rd., Pensacola, Fla. 32533

[21] Appl. No.: 603,451

[22] Filed: Feb. 20, 1996

[51] Int. Cl.[6] ..... A47F 7/00

[52] U.S. Cl. ..... 211/189; 211/37; 211/206

[58] Field of Search ..... 211/189, 206, 211/182, 34, 37, 204, 13

[56] References Cited

U.S. PATENT DOCUMENTS

| | | | |
|---|---|---|---|
| 2,815,862 | 12/1957 | Einhorn | 211/37 |
| 3,197,035 | 7/1965 | Wolf | 211/204 |
| 4,068,855 | 1/1978 | Hackett | 211/189 X |
| 4,093,078 | 6/1978 | Rodek | 211/189 |
| 4,463,853 | 8/1984 | Licari et al. | 211/37 |
| 5,190,305 | 3/1993 | Putman | 211/206 X |
| 5,348,165 | 9/1994 | Pomerleau | 211/13 |
| 5,377,849 | 1/1995 | Martin | 211/13 |

FOREIGN PATENT DOCUMENTS

| | | | |
|---|---|---|---|
| 805993 | 2/1969 | Canada | 211/206 |

*Primary Examiner*—Robert W. Gibson, Jr.
*Attorney, Agent, or Firm*—Peter Loffler

[57] ABSTRACT

A diassembleable drying rack is disclosed. The drying rack is comprised of a generally rectangular shaped, either symmetrical or non-symmetrical, frame assembly. Each cross member of the frame assembly has hook means for receiving gloves, flippers and the like thereon. An extension member, located on top of the frame assembly receives hanger hung wet suits, vests and the like. J-hooks located on the extension member receive masks, hoses and the like.

7 Claims, 5 Drawing Sheets

36
38
42
42
30
22
10
12
30
12
22

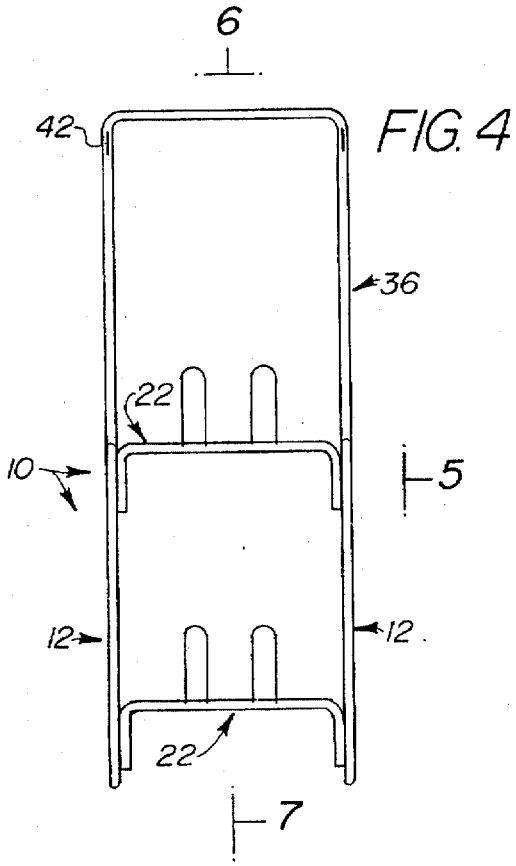
FIG. 4
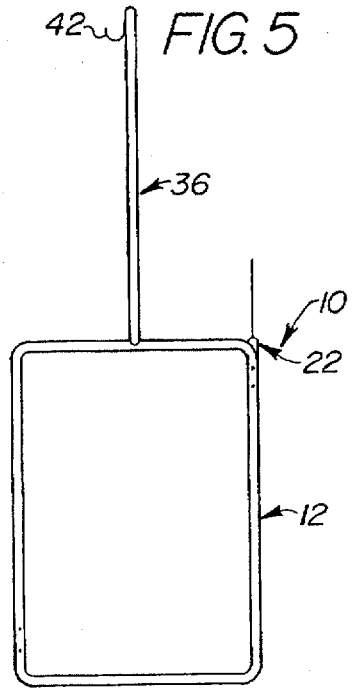
FIG. 5
FIG. 6
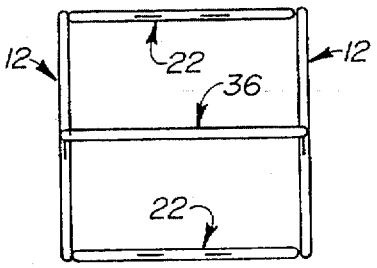
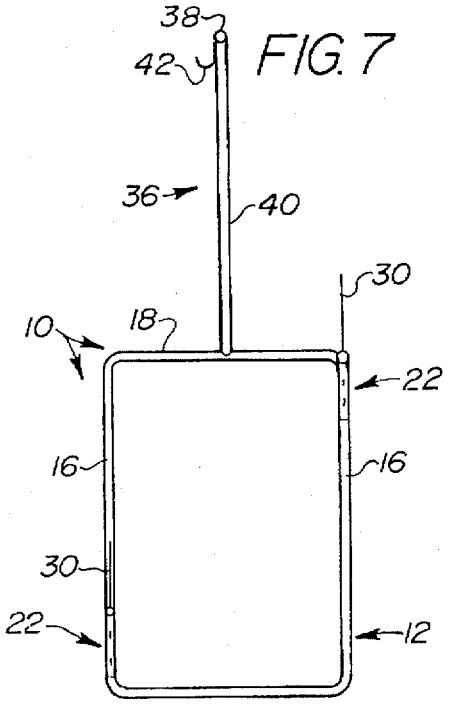
FIG. 7

DRYING RACK

BACKGROUND OF THE INVENTION

1. Field of the Invention

The present invention relates to a drying rack for hanging scuba diving and other equipment thereon.

2. Background of the Prior Art

Scuba diving requires the use of several pieces of equipment including a wet suit, air tanks, flippers, vest, glove, mask, belts and hoses among others. When the scuba diver completes his dives, appropriate equipment care requires that the equipment be suitably dried out. In most cases ambient air drying proves satisfactory. In order to accomplish such drying, the diver will typically hang each piece of equipment on any suitable protrusion that can serve as a hook. Not only does this present a sloppy and unsightly appearance, the effectiveness of such hanging may be limited and the diver may be faced with equipment that is still wet just before his next dive.

A device is needed that is designed for placement of diving equipment and other equipment thereon for effective ambient air drying of the equipment so placed. Such a device must be of simple design, construction and use and must be able to hold the various pieces of diving equipment, as well as other types of equipment, that a diver uses. Ideally, the rack will hold other types of equipment that is subject to water exposure.

SUMMARY OF THE INVENTION

The device of the present invention meets the above-identified needs in the art. The device provides a simple drying rack for hanging scuba diving and other types of equipment thereon for effective ambient air drying of the equipment.

The drying rack of the present invention comprises a generally rectangular solid-shaped, either symmetrical or non-symmetrical, frame assembly having a generally U-shaped extension member protruding upwardly in inverted fashion. Located on a front cross member of the frame assembly are a set of generally inverted U-shaped hook members while a second set of generally inverted U-shaped hook members are located on the rear cross member.

The diver's flippers are impaled on one set of these hook members while the diver's gloves are impaled on the other set of these hook members. Such impalement renders the flippers and gloves in upside down displacement allowing excess water to drip off, thereby speeding the drying process. Furthermore, the hooks open the interior of the gloves and flippers permitting appropriate drying of the interior.

A set of J-hooks are located on the extension member for hanging of the diver's mask and hose assembly thereon. The diver's suit and vest is hanger placed on the cross member of the extension. This cross member is of sufficient distance from the ground so that suit does not contact the ground. Any miscellaneous equipment such as a belt, camera, spear gun, etc., can be placed on or otherwise wrapped around one or more of the generally inverted U-shaped hook members.

Alternatively, equipment such as a fisherman's boots, a kayaker's vest, fire fighter's jacket and helmet and other types of equipment that gets wet during use can make effective use of the rack.

Assembly and disassembly of the device is quick and easy. The front and rear cross members of the frame assembly are boltably attached to the end members. An upwardly facing extension rod is located on each of the end members with each extension rod friction fit receiving one end of the extension member. Such construction permits quick assembly after a dive. Quick disassembly permits easy collapse of the device for easy transport.

BRIEF DESCRIPTION OF THE DRAWINGS

FIG. 4 is a front elevation view of the drying rack of the present invention.

FIG. 5 is a side elevation view of the drying rack of the present invention.

FIG. 6 is a top plan view of the drying rack of the present invention.

FIG. 7 is a is a cutaway view of FIG. 5.

Similar reference numerals refer to similar parts throughout the several views of the drawings.

DETAILED DESCRIPTION OF THE PREFERRED EMBODIMENT

Figure 1:
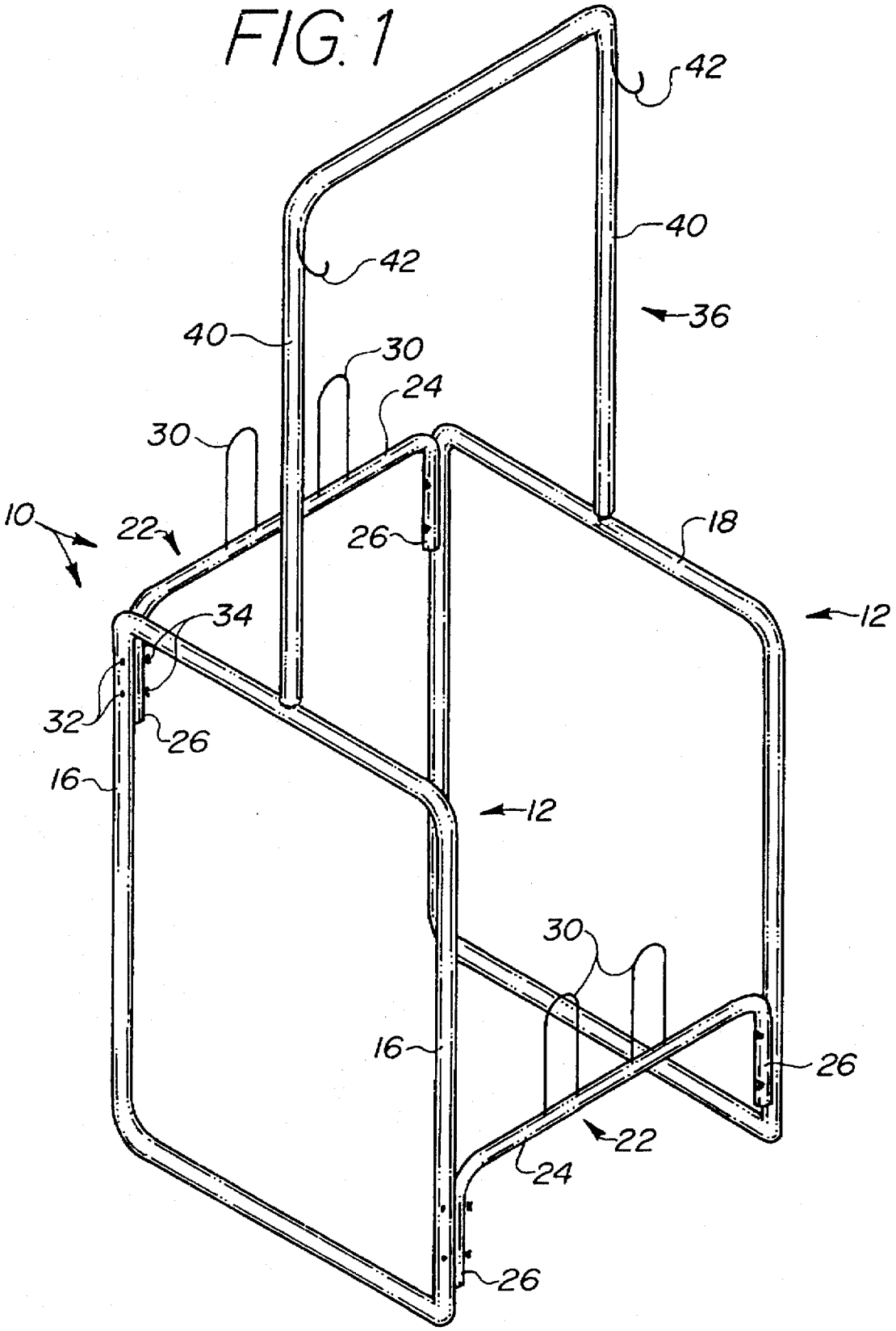
FIG. 1 is a perspective view of the drying rack of the present invention.
Figure 2:
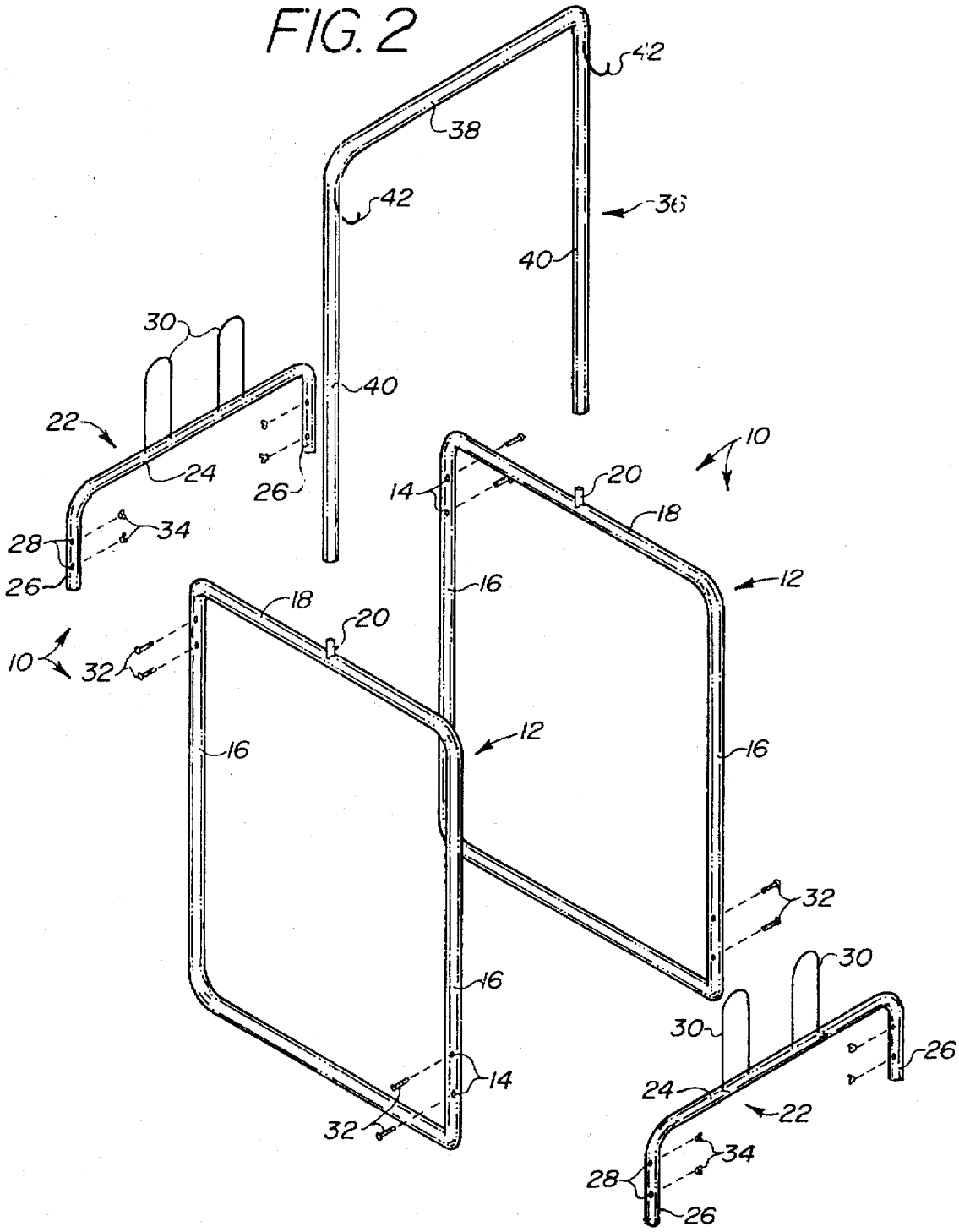
FIG. 2 is an exploded view of the drying rack of the present invention.

The drying rack of the present invention comprises a frame assembly generally labeled by reference numeral 10. The frame assembly 10 is generally rectangular shaped, either symmetrical or non-symmetrical, and is comprised of a pair of end members 12 disposed in parallel relation to one another. Each end member 12 is a rectangular-shaped frame member and has a first set of apertures 14 on one of the end members' vertical legs 16 and a second set of apertures 14 on the other end members' vertical legs 16. Located on each of the end members' upper horizontal leg 18 is an extension rod 20, facing upwardly.

A pair of cross members 22 are disposed between the parallel end members 12. As seen, each cross member 22 is generally U-shaped having a base 24 and two ends 26. Each end 26 of the cross member 22 has a set of apertures 28 located thereon. Located on the base 24 of the cross member is a set of generally inverted U-shaped hook members 30.

Each set of apertures 28 of one cross member 22 is aligned with one set of corresponding apertures on each of the end members 12. A bolt 32 is inserted through each of the aligned apertures while a wing nut 34 securely holds each bolt 32 in place. The other cross member 22 also connects the two end members 12 in similar fashion.

An extension member 36 is generally U-shaped having a base 38 and two ends 40. Each end 40 is a hollow tubular member and has a J-hook 42 located thereon.

Once the frame member 10 is assembled, the ends 40 of the extension member 36 are placed over each extension rod 20. Each end 40 receives its respective extension rod 20 and thereby friction holds the extension member 36 in place on top of the frame assembly 10.

Figure 3:
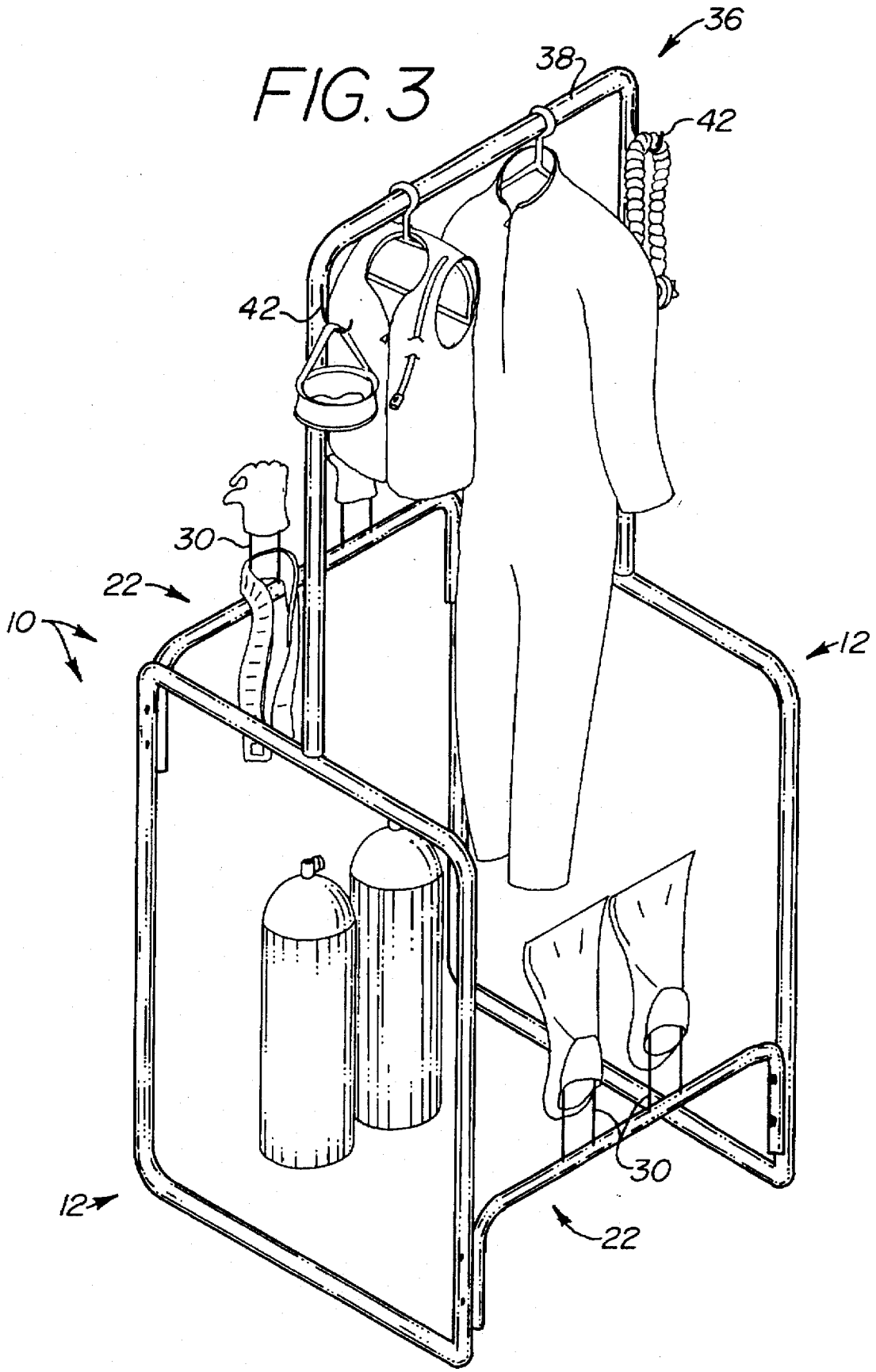
FIG. 3 is a perspective view of the drying rack with various diving equipment placed thereon.
Figure 8:
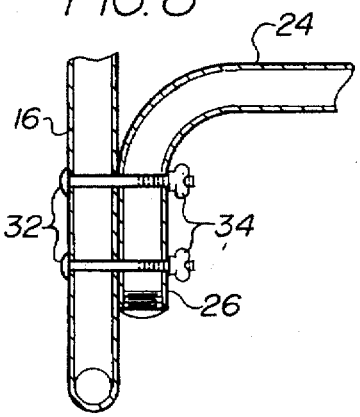
FIG. 8 is a cutaway view of the bolt assembly between the cross member end the end member.
Figure 9:
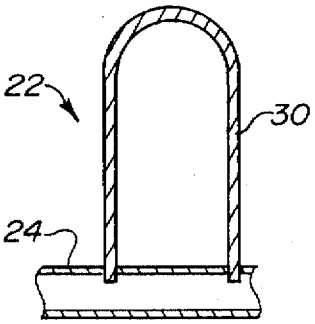
FIG. 9 is a cutaway view of the generally inverted U-shaped hook member.
Figure 10:
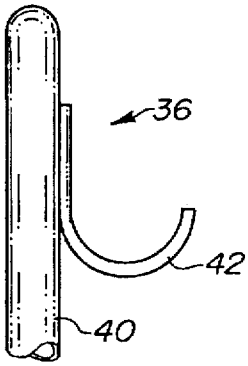
FIG. 10 is a side elevation view of the J-hook member.
Figure 11:
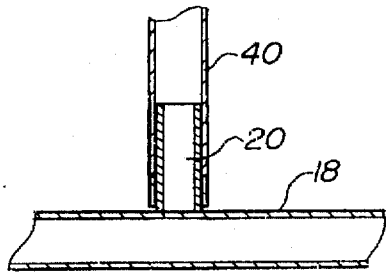
FIG. 11 is a cutaway view of the extension member receiving the extension rod.

As seen in FIG. 3, the various pieces of diving equipment can be placed onto the assembled drying rack. The diver's flippers are each impaled on one set of generally inverted U-shaped hooks 30 while the gloves are impaled on the other set of generally inverted U-shaped hooks 30. Each hook 30 acts to open the interior of the glove or flipper for drying of each interior. The mask and the hose assembly can each be hanged from one of the J-hooks 42. The wet suit and the vest are each placed on a hanger and the hanger is hanged on the base 38 of the extension member 36. Any remaining equipment such as a belt, camera, light, spear gun, etc., can be hanged or otherwise wrapped around one of the generally inverted U-shaped hooks 30.

By using bolts with wing nuts to join the cross members 22 to the end members 12 and friction holding the extension member 36 on top of the end members 12, the device is simple to assemble and disassemble and once disassembled, the device can be placed into a relatively compact pile for easy transport. Alternatively, pivot means (not illustrated) can be used to hold each cross member 22 to the end members 12. In such an arrangement, the end members 12 and the cross members 22 unfold into place and fold for storage and transport.

While the invention has been particularly shown and described with reference to an embodiment thereof, it will be understood by those skilled in the art that various changes in form and detail may be made without departing from the spirit and scope of the invention.

I claim:

1. A drying rack comprising:

a frame assembly having a pair of parallel disposed end members and a first cross member and a second cross member joining the two end members;

a first set of hook means located on the first cross member and a second set of hook means located on the second cross member;

a generally U-shaped extension member located on top of the frame assembly in inverted fashion; and a third set of hook means, comprising at least one J-hook, located on the extension member.

2. The device as in claim 1 wherein the frame assembly is generally rectangular shaped.

3. The device as in claim 2 wherein the end members are generally rectangular-shaped.

4. The device as in claim 1 wherein the frame assembly is generally cube-shaped.

5. The device as in claim 4 wherein the end members are generally square-shaped.

6. The device as in claim 1 wherein the first set of hook means comprises at least one generally U-shaped member protruding upwardly in inverted relation and the second set of hook means comprises at least one generally U-shaped member protruding upwardly in inverted relation.

7. The device as in claim 1 wherein the first cross member and the second cross member are each boltably attached to each of the end members.

* * * * *